United States Patent [19]

Battle

[11] Patent Number: 5,063,821

[45] Date of Patent: Nov. 12, 1991

[54] MOUNTING ARRANGEMENT FOR PERCUSSION INSTRUMENTS

[76] Inventor: A. Kainin Battle, Charlie Co., 3rd Batallion, 17th Regiment, Fort Ord, Calif. 93941

[21] Appl. No.: 436,715

[22] Filed: Nov. 15, 1989

[51] Int. Cl.[5] ..... G10H 3/00; G10H 1/32; G10G 5/00; G10D 13/08

[52] U.S. Cl. ..... 84/723; 84/743; 84/746; 84/DIG. 12; 84/DIG. 24; 84/411 R; 84/421

[58] Field of Search ..... 84/723, 725, 730, 743, 84/746, 411 R, 102.4, 106, 420, 421, DIG. 12, 464 R, 464 A, 402, 403, 414

[56] References Cited

U.S. PATENT DOCUMENTS

| | | | |
|---|---|---|---|
| 2,988,825 | 8/1959 | Wilson | 35/29 |
| 3,439,568 | 4/1969 | Griffith | 84/600 |
| 3,659,032 | 4/1972 | May | 84/600 |
| 3,893,363 | 7/1975 | Cohen | 84/402 |
| 3,922,944 | 12/1975 | Kurosaki et al. | 84/464 |
| 3,956,958 | 5/1976 | Nash et al. | 84/DIG. 7 X |
| 3,956,959 | 5/1976 | Ebihara et al. | 84/725 |
| 4,245,539 | 1/1981 | Jones | 84/672 |
| 4,303,969 | 12/1981 | Hamilton et al. | 362/153 |
| 4,491,050 | 1/1985 | Franzmann | 84/746 |
| 4,669,353 | 6/1987 | Kristad | 84/403 |
| 4,679,479 | 7/1987 | Koyamoto | 84/743 |
| 4,691,611 | 9/1987 | May | 84/421 |
| 4,924,741 | 5/1990 | Vollenweider | 84/730 |
| 4,955,276 | 9/1990 | Feldman et al. | 84/403 |

*Primary Examiner*—William M. Shoop, Jr.
*Assistant Examiner*—Jeffrey W. Donels
*Attorney, Agent, or Firm*—William D. Hall

[57] ABSTRACT

A percussion instrument employs a horizontal surface whose dimensions are about 1 foot×2 feet×⅜ inch made of oak. This piece of oak has transducers on its under side and is spaced one or two inches above the floor. The percussionist sits on a stool where he can tap this piece of oak with the heels and toes of his shoe. Mounted at an elevation and position within easy reach of the percussionist are a number of tubular drums which the percussionist may strike with a drumstick. These tubular drums are about two inches in diameter and each of them has a central cavity in which a transducer is located.

15 Claims, 2 Drawing Sheets

MOUNTING ARRANGEMENT FOR PERCUSSION INSTRUMENTS

BACKGROUND OF THE INVENTION

In the past bass drums, and other such percussion instruments, have been mounted on the floor and are operated by the drummer who sits in a chair and beats the drum by operating a pedal with his foot. Other percussion instruments may be mounted on the drum, or on stands, near to the main drum. The large drums on the floor often obscure the percussionist from the audience and the audience from the percussionist. Another problem with the prior art drums is that there is a physical barrier or division interposed between the drum and the drummer, in that the drummer beats the drum indirectly by way of a foot pedal and a beater.

SUMMARY OF THE INVENTION

The preferred form of my invention solves the above problems and involves a number of relatively small tubular drums and a piece of material (having dimensions such as 1 foot by 2 feet by ⅜ inch thick) such as wood, and preferably oak, mounted an inch or two above the floor. Hereafter, I will call this piece of material, the oak percussion surface. The percussionist may tap on the oak percussion surface with the heels and toes of his shoes. Both the tubular drums and the oak percussion surface have transducers to convert the mechanical vibrations into electrical signals that trigger or activate conventional electric sound generation devices (signal processors) in accordance with well known techniques.

With my arrangement, the percussionist may strike the tubular drums with drumsticks and strike the oak percussion surface with the heels and toes of his shoes. This permits the percussionist to see the audience and also permits the audience to see the percussionist.

Because there is direct contact between the percussionist's shoe and the oak percussion surface, there is no need for the usual pedal and drum beater.

Moreover, with my invention the use of tap techniques forces the player to conform to a total upper and lower body coordinated style of playing. This style of playing involves keeping the percussionist's back straight, and his point of balance in the lower hip area; in essence, balancing on the edge of the stool so that independent heel and toe inputs by both feet can be applied to the oak precussion surface.

Direct foot contact with the oak percussion surface emphasises the heel-toe percussion teachniques of tap.

It is also possible to have a stage size oak percussion surface with an unlimited number of transducers that trigger a variety of sounds and effects when a tap dancer performs on the surface.

DETAILED DESCRIPTION OF THE INVENTION

Figure 1:
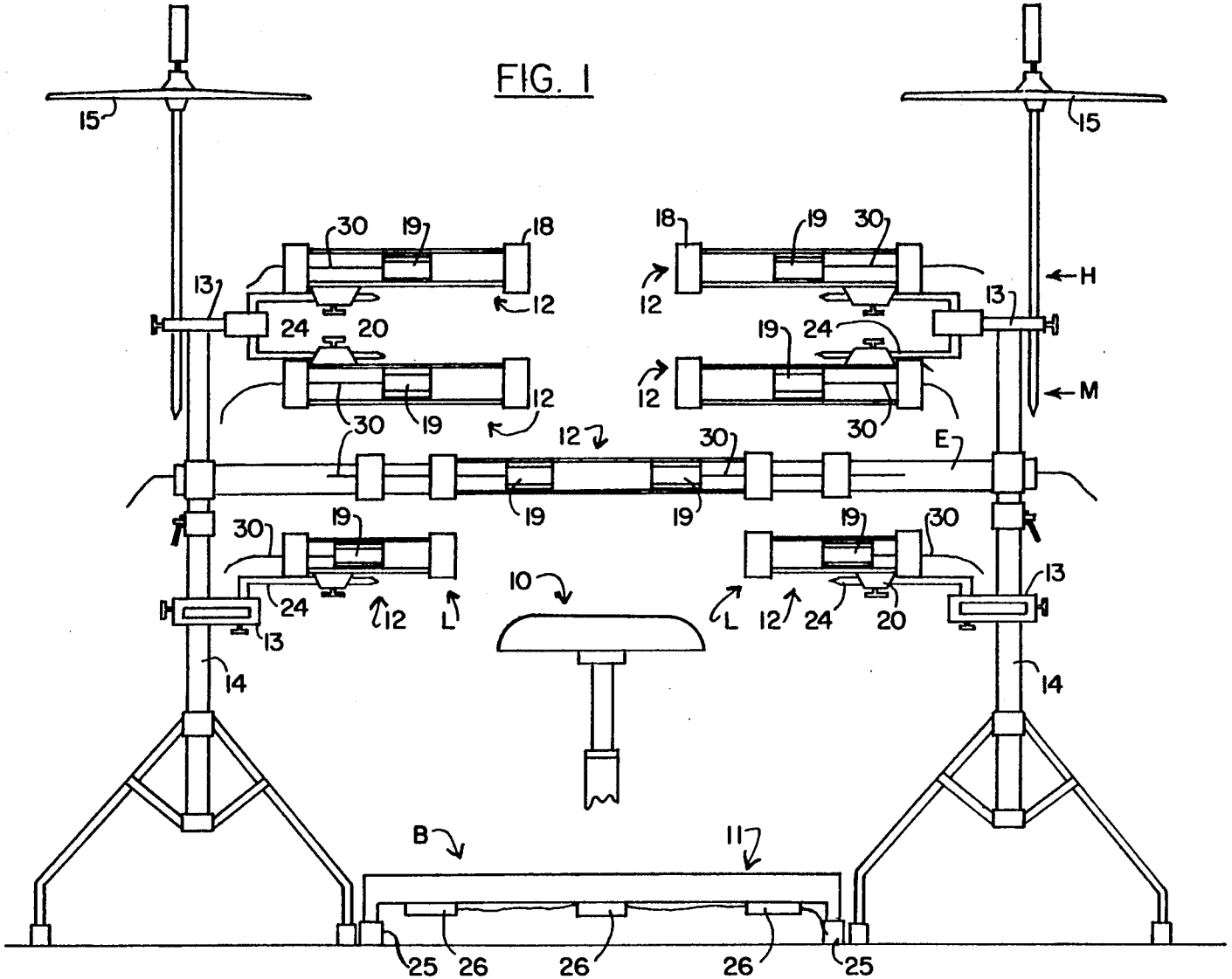
FIG. 1 is a front view of the arrangement of tubular drums and the oak percussion member.
Figure 2:
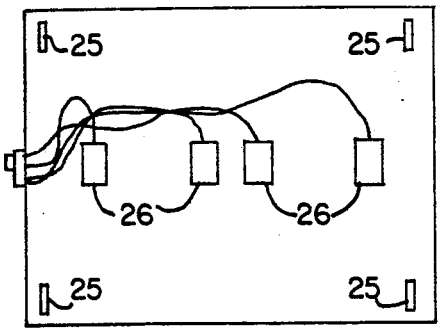
FIG. 2 illustrates one possible location of the transducers on the underside of the oak percussion surface.

As shown in FIG. 1, the percussionist sits on stool 10 so that his feet have easy access to oak percussion surface 11, and so that he may readily strike the several tubular drums 12 with a suitable drum sticks.

The tubular drums 12 are mounted on supporting devices 13 which in turn are supported by vertical supporting rods 14.

Figure 4:
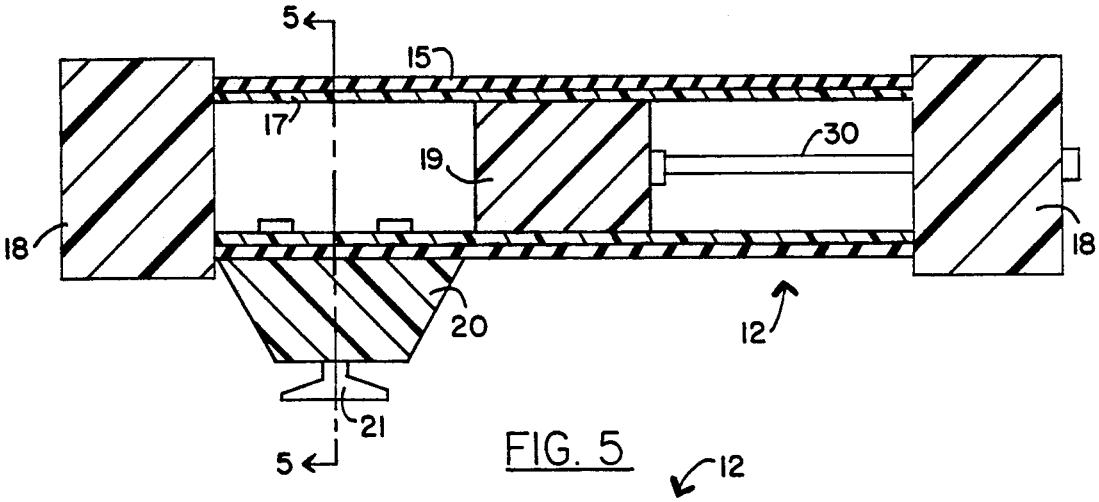
FIG. 4 is a cross-sectional view of a typical tubular drum.
Figure 5:
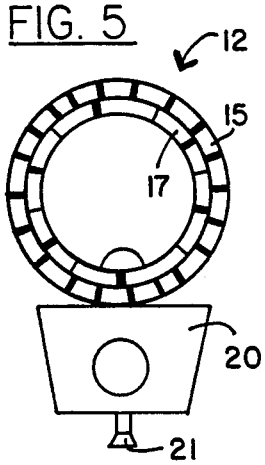
FIG. 5 is a cross-section view taken along line 5—5 of FIG. 4.

The construction of a typical tubular drum 12 is shown in FIGS. 4 and 5. An outer cylinder 15 of clear rubber tubing two inches in diameter is supported by a plastic inner cylinder 17. Two ends caps 18 close the ends of the tubular drum 12. A standard hardware supporting member 20 is attache to the tubular drum 12 and has a set screw 21 for holding the member 20 onto a conventional supporting rod 24. (FIG. 1). The conventional supporting stand 14 supports the supporting elements 13 and the cymbal 15. Transducer 19, which fits tightly in inner cylinder 17, converts the mechanical vibrations of the tubular drum 12 into electrical signals which flow over output wire 30. For example, the transducer 19 is, in one desirable form, a conventional condenser type of transducer whose electrical capacity varies in accordance with the mechanical vibrations.

The percussion surface 11 is preferably made of oak and has dimensions of 1 foot by 2 feet by ⅜ inch thick. It may, of course, be made of any suitable material and in suitable size. The oak percussion surface 11 is mounted 1 to 2 inches above the floor by legs or spacers 25 and it has at least one, and preferably, several transducers 26 mounted on the underside of the piece of oak 11.

Figure 3:
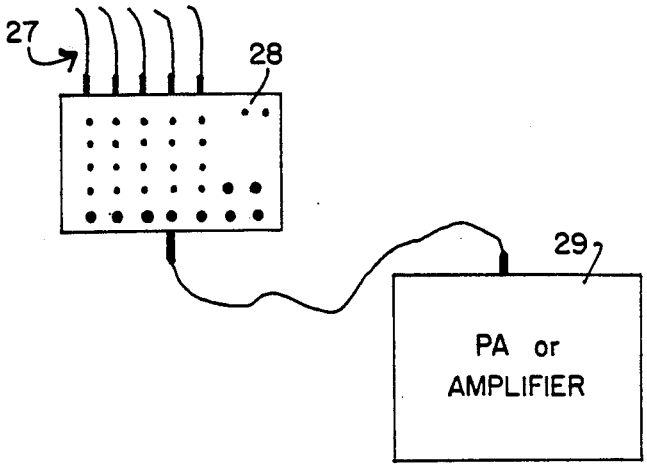
FIG. 3 is a block diagram of the electrical circuit, which may be used with the apparatus embodying my invention.

The block diagram of FIG. 3 shows that the wires from the transducers 19 and 26 are fed to a suitable conventional signal processing unit 28 and then amplified in a power amplifier 20so as to be suitable for driving a conventional loud speaker (now shown).

Signal processing equipment, for performing the function of signal processing unit 28, that may be connected to the transducers and which will feed power amplifiers are standard and very well known. One suitable signal processor is the LinnDrum, manufactured by Linn Electronics, Inc., 18720 Oxnard St., Tarzana, Calif. 91356.

Other suitable signal processors, or tone generators as they are referred to in the music industry, are made by:

(a) Korg USA, 89 Frost St., Westbury, N.Y. 11590

(b) Roland Corp. US. 7200 Dominion Circle Los Angeles, Calif. 90040-3647

(c) Yamaha Corporation of America Synthesizer, Guitar and Drum Division, 6600 Orangethorpe Ave., Buena Park, Calif. 90620

(d) Alesis Corporation, 3630 Holdrege Avenue, Los Angeles, Calif. 90016.

My tubular drum 12 differs from drums already on the market in its cylindrical shape, a more defined strike zone due to it approximate one inch in width by 12 inches length, and better stick control also due to the size and shape of the surface area. The differences between my bass drum and those already on the market lie in its utility. These differences are:

(1) The use of direct foot contact with the playing surface.

(2) The horizonal rather than conventional vertical position of the playing surface.

When I stated that the strike zone was approximately one inch in width by twelve inches in length, I was referring to the size of the playing surface (the area of which the sticks actually strike the tube at any given time).

When drum sticks are played on a conventional flat surface, only the tips of the sticks come into contact with the playing surface, and it is the resilience of the playing surface only, that springs the sticks back into a position to strike again. When playing on a cylindrical surface, the sticks hit the tube at about one inch down from the tips of the sticks. This creates a leverage induced reaction, along with the resilience of the playing surface that returns the sticks to the strike position faster, thereby making it easier for the drummer to play faster with more control.

Conventional signal processors (tone generators) including at least some of the commercial devices listed above have anywhere from four to sixteen memory banks. Each such bank stores a different tone which is fed out to the power amplifier in response to a signal from a transducer 19. One or more of transducers 19 in tubes 12 feed a given bank. In the drawing, for example . . . Top tubes (row H)=High tone. Middle tubes (row M)=mid tone. Long tube E in center=snare tone (the snare drum tone is a brassy buzzy type sound that is used with all conventional drum sets). Low tubes L=low tone. Bass drum unit B=bass tone.

When the apparatus of FIG. 1 is in use, the precussionst, sitting on the stool 10, strikes the tubular drums 12 with a drum-stick and taps the oak percussion surface 11 with the toes and heels of his shoes. The resulting mechanical vibrations are converted to electrical signals by the transducers 19 and 26. The electrical signals are then utilized as is well known in the art to drive loud speakers.

I claim to have invented:

1. A percussion instrument comprising:

a percussion element having a percussion surface, said element comprising means for vibrating when tapped by a shoe, transducer means for converting mechanical vibrations of said element into electrical signals, drum means adjacent said percussion element, so that said drum means may be struck by a percussionist with drumsticks and said surface may be struck by the feet of said percussionist, and means for mounting said percussion surface horizontally.

2. A percussion instrument as defined in claim 1, in which said element has substantial thickness with said surface as the top side of said element, said element having an underside, said transducer means being in physical contact with said underside, and spacer means for spacing said underside adjacent to and above any floor on which the element may be placed.

3. A percussion instrument as defined in claim 2 in which said element is oak.

4. A percussion instrument as defined in claim 1, in which said drum means comprises a plurality of drums mounted at a level substantially higher than the level of said surface.

5. A percussion instrument as defined in claim 2 in which said drum means comprises a plurality of elongated tubular drums located in a common vertical plane with one of the drums above another one.

6. A percussion instrument comprising:

a percussion element having a top side constituting a percussion surface, said element having sufficient strength so as to withstand the stress of normal impact when struck by the heel or toe of a shoe of a percussionist, said percussion element comprising means for vibrating to a substantial degree when struck by the heel or toe of a shoe, means for mounting said element so that when it is placed on a supporting surface such as a floor it is spaced above such supporting surface with said percussion surface substantially horizontal, transducer means associated with said element for converting mechanical vibrations of said element into electrical signals, in which said element has an underside, said transducer means being mounted on said underside, and said element composed of hard wood.

7. A percussion instrument comprising:

a percussion element having a top side constituting a percussion surface, said element having sufficient strength so as to withstand the stress of normal impact when struck by the heel or toe of a shoe of a percussionist, said percussion element comprising means for vibrating to a substantial degree when struck by the heel or toe of a shoe, means for mounting said element so that when it is placed on a supporting surface such as a floor it is spaced above such supporting surface with said percussion surface substantially horizontal, transducer means associated with said element for converting mechanical vibrations of said element into electrical signals, a plurality of drums in a common vertical plane, said drums being at different elevations in said plane, said plane being adjacent said element, and said element and said drums being positioned, so that said surface may be tapped by the shoes of a percussionist while in a given position, and so that the percussionist while in said position may strike said drums with sticks.

8. A percussion instrument as defined in claim 7, including supporting means for supporting a percussionist in said given position.

9. A percussion instrument as defined in claim 8 in which said supporting means comprises a stool.

10. A percussion instrument as defined in claim 8 in which there are at least three different drums at three different elevations in said plane, means for producing a first tone when the top one of said drums in struck, means for producing a second tone of a frequency lower than the frequency of said first tone when the middle drum is struck, and means for producing a third tone of a frequency lower than the frequency of said second tone when the lowermost one of said drums is struck.

11. A percussion instrument, comprising:

a plurality of tubular drums, a signal producing means for each drum, for producing an electrical signal when the drum is struck by a drumstick, and means for mounting said drums at different elevations and in a common vertical plane.

12. A percussion instrument as defined in claim 11, including a plate mounted for vibratory motion adjacent said plane so that the plate may be struck by a percussionist in a given sitting position and the drums may be struck with drumsticks by said percussionist.

13. A percussion instrument as defined in claim 11, comprising:

said tubular drums each having a cavity, each said signal producing means comprising a transducer in the cavity that is in the drum with which the signal producing means is associated.

14. A percussion instrument as defined in claim 13, in which at least one of said drums has a resilient outer surface that applies a spring action to a drumstick that strikes said surface.

15. A percussion instrument as defined in claim 14, in which said drums are cylindrical.

* * * * *